US009196959B1

(12) United States Patent
Doane et al.

(10) Patent No.: US 9,196,959 B1
(45) Date of Patent: Nov. 24, 2015

(54) MULTI-RING SWITCHED PARASITIC ARRAY FOR IMPROVED ANTENNA GAIN

(75) Inventors: Jonathan P. Doane, Cedar Rapids, IA (US); Dana J. Jensen, Marion, IA (US)

(73) Assignee: rockwell Collins, Inc., Cedar Rapids, IA (US)

( * ) Notice: Subject to any disclaimer, the term of this patent is extended or adjusted under 35 U.S.C. 154(b) by 1244 days.

(21) Appl. No.: 12/977,198

(22) Filed: Dec. 23, 2010

(51) Int. Cl.
*H01Q 9/00* (2006.01)
*H01Q 3/26* (2006.01)
*H01Q 21/00* (2006.01)

(52) U.S. Cl.
CPC ..... *H01Q 3/2617* (2013.01); *H01Q 3/2605* (2013.01); *H01Q 21/00* (2013.01)

(58) Field of Classification Search
USPC ..... 343/837, 893, 751, 833
See application file for complete search history.

(56) References Cited

U.S. PATENT DOCUMENTS 4,700,197 A * 10/1987 Milne ..... 343/837
5,121,127 A * 6/1992 Toriyama ..... 343/700 MS
6,407,719 B1 * 6/2002 Ohira et al. ..... 343/893
2006/0001525 A1 * 1/2006 Nitzan et al. ..... 340/10.1

* cited by examiner

*Primary Examiner* — Hoang V Nguyen
*Assistant Examiner* — Hai Tran
(74) *Attorney, Agent, or Firm* — Angel N. Gerdzhikov; Donna P. Suchy; Daniel M. Barbieri

(57) ABSTRACT

The present disclosure is directed to a multi-ring switched parasitic array for improved antenna gain. The array includes multiple rings of parasitic elements configured around a central monopole element. Each parasitic element may be connected to a corresponding load circuit. Variable impedances may be applied to the parasitic elements via the variable impedance loads for causing the antenna array to produce a desired radiation pattern and/or for increasing gain of directional beams radiated by the parasitic antenna array.

19 Claims, 7 Drawing Sheets

MULTI-RING SWITCHED PARASITIC ARRAY FOR IMPROVED ANTENNA GAIN

CROSS-REFERENCE TO RELATED APPLICATIONS

U.S. patent application Ser. No. 12/729,372 entitled: An Improved Parasitic Antenna Array Design for Microwave Frequencies filed Mar. 23, 2010 (pending) is hereby incorporated by reference in its entirety herein.

FIELD OF THE INVENTION

The present disclosure relates to the field of antenna technology (ex.—multifunction antennas) and particularly to a multi-ring switched parasitic array for improved antenna gain.

BACKGROUND OF THE INVENTION

Currently available parasitic antenna arrays may implement variable reactance via a single component, such as a PIN diode, a varactor diode, or a variable capacitor. Further, with said currently available parasitic antenna array implementations, a standard DC bias network may be attached which uses a large resistance or inductance for an RF choke. In these currently available implementations, the effects of the interconnect impedance (such as via inductance) are neglected. Such effects may become increasingly significant at higher frequencies, especially if tuned structures, such as quarter wavelength lines, are used. Thus, these currently available implementations fail to produce the requisite impedances for proper high efficiency operation of a parasitic array at higher microwave frequencies (ex.—frequencies greater than 3 Gigahertz (GHz)). Further, the currently available antenna arrays may be low gain, large, heavy and/or expensive. Still further, the currently available antenna arrays may be impractical for implementation with Unmanned Aerial Vehicles (UAV) or soldier platforms.

Thus, it would be desirable to provide a parasitic antenna array implementation which obviates the problems associated with currently available implementations.

SUMMARY OF THE INVENTION

Accordingly, an embodiment of the present disclosure is directed to a parasitic antenna array, including: a substrate; a monopole element, the monopole element being connected to the substrate, the monopole element configured for radiating electromagnetic energy in an omni-directional radiation pattern; a first plurality of parasitic elements, the first plurality of parasitic elements being connected to the substrate, the first plurality of parasitic elements collectively forming a first ring, said first ring being formed around the monopole element; and a second plurality of parasitic elements, the second plurality of parasitic elements being connected to the substrate, the second plurality of parasitic elements collectively forming a second ring, said second ring being formed around the monopole element and being formed around the first ring.

An additional embodiment of the present disclosure is directed to a method of operation of a parasitic antenna array, the method including: transmitting a first current from a DC bias current source of a first load circuit of the parasitic antenna array to a resistor of the first load circuit; providing a second current from the resistor of the first load circuit to a capacitor of the first load circuit, the second current being based upon the first current; transmitting a third current from the capacitor of the first load circuit to a plurality of diodes of the first load circuit, the third current being based upon the second current, the third current including a DC bias current; providing an impedance from the plurality of diodes of the first load circuit to a first parasitic element of the parasitic antenna array, the impedance being based upon the DC bias current included in the third current; transmitting a fourth current, the fourth current being transmitted from a DC bias current source of a second load circuit of the parasitic antenna array to a resistor of the second load circuit; providing a fifth current from the resistor of the second load circuit to a capacitor of the second load circuit, the fifth current being based upon the fourth current; transmitting a sixth current from the capacitor of the second load circuit to a plurality of diodes of the second load circuit, the sixth current being based upon the fifth current, the sixth current including a DC bias current; providing an impedance from the plurality of diodes of the second load circuit to a second parasitic element of the parasitic antenna array, the impedance being based upon the DC bias current included in the sixth current; receiving an RF feed via an RF feed line; in response to receiving said RF feed, radiating electromagnetic energy in an omni-directional radiation pattern via a monopole element of the parasitic antenna array; reflecting the radiated electromagnetic energy via the first parasitic element, the first parasitic element being one of a first plurality of parasitic elements, said first plurality of parasitic elements forming a first ring, said first ring being formed around the central monopole; and reflecting the radiated electromagnetic energy via the second parasitic element, the second parasitic element being one of a second plurality of parasitic elements, said second plurality of parasitic elements forming a second ring, said second ring being formed around the central monopole and also being formed around the first ring.

A further embodiment of the present disclosure is directed to a parasitic antenna array, including: a substrate; a monopole element, the monopole element being connected to the substrate, the monopole element configured for radiating electromagnetic energy in an omni-directional radiation pattern; a first plurality of parasitic elements, the first plurality of parasitic elements being connected to the substrate, the first plurality of parasitic elements collectively forming a first ring, said first ring being formed around the monopole element; a second plurality of parasitic elements, the second plurality of parasitic elements being connected to the substrate, the second plurality of parasitic elements collectively forming a second ring, said second ring being formed around the monopole element and being formed around the first ring; and a plurality of load circuits, the plurality of load circuits being connected to the parasitic elements and the ground plane, wherein a first load circuit included in the plurality of load circuits is connected to a base of a first parasitic element included in the parasitic elements, said load circuit being configured for providing an adjustable impedance to the first parasitic element, wherein the first parasitic element is selectively configurable, based upon the impedance provided to the first parasitic element by the first load circuit, for one of: reflecting the electromagnetic energy radiated from the monopole element; and allowing transmission through the first parasitic element of the electromagnetic energy radiated from the monopole element.

It is to be understood that both the foregoing general description and the following detailed description are exemplary and explanatory only and are not necessarily restrictive of the invention as claimed. The accompanying drawings, which are incorporated in and constitute a part of the specification, illustrate embodiments of the invention and together with the general description, serve to explain the principles of the invention.

BRIEF DESCRIPTION OF THE DRAWINGS

The numerous advantages of the present disclosure may be better understood by those skilled in the art by reference to the accompanying figures in which.

DETAILED DESCRIPTION OF THE INVENTION

Reference will now be made in detail to the presently preferred embodiments of the invention, examples of which are illustrated in the accompanying drawings.

Figure 1:
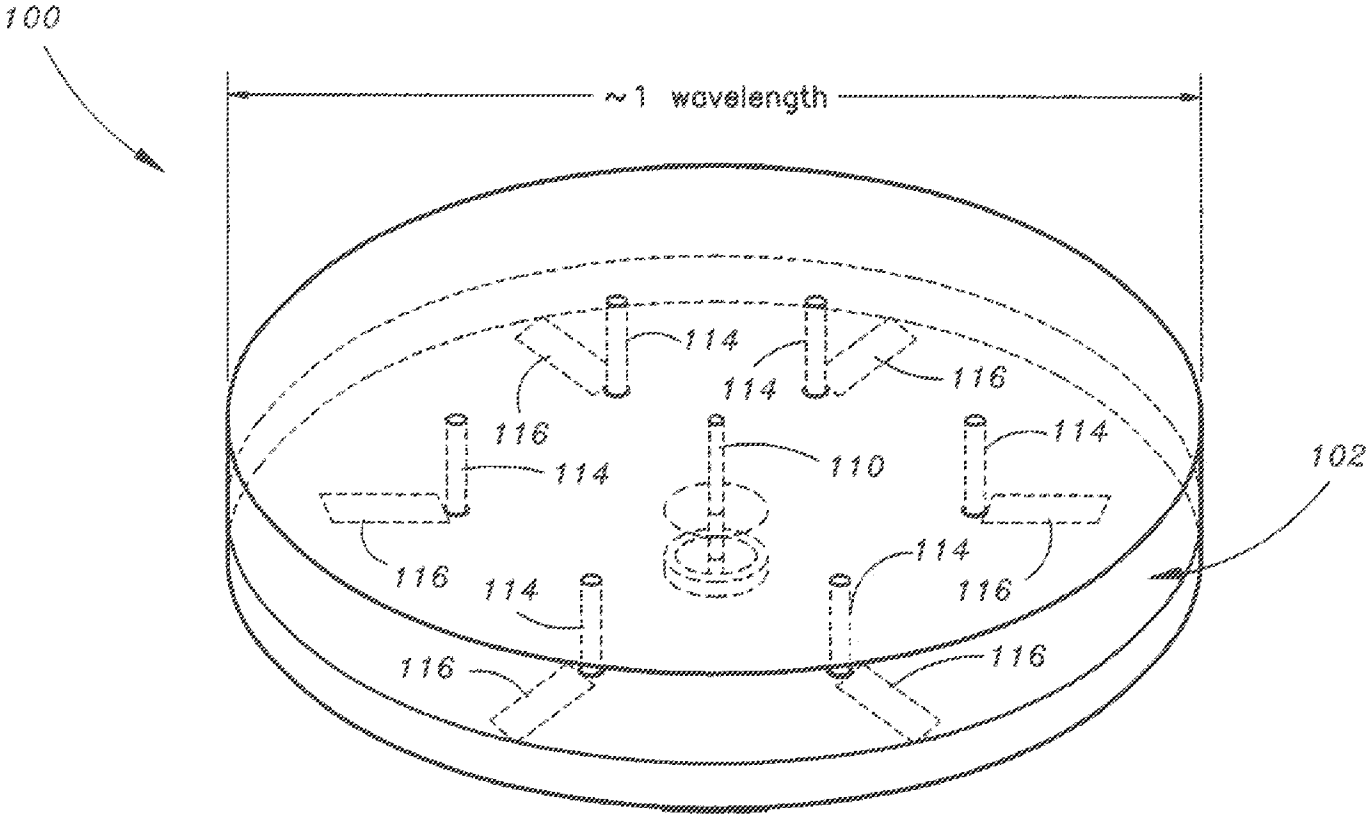
FIG. 1 is a view of a parasitic antenna array in accordance with an exemplary embodiment of the present disclosure.
Figure 2A:
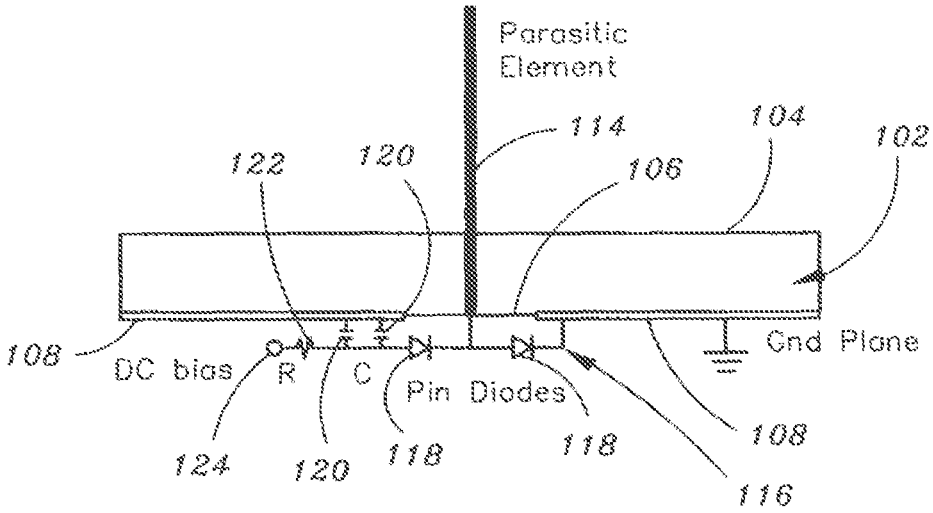
FIG. 2A is a view of a load circuit connected to the substrate of the parasitic array shown in FIG. 1 in accordance with an exemplary embodiment of the present disclosure.

Referring to FIG. 1, an antenna array (ex.—an antenna) in accordance with an exemplary embodiment of the present disclosure is shown. In a current exemplary embodiment of the present disclosure, the antenna array 100 may be a parasitic antenna array (ex.—a parasitic antenna) 100. In further embodiments of the present disclosure, the parasitic antenna array 100 may include a substrate 102. In exemplary embodiments of the present disclosure, the substrate 102 may be at least partially formed of printed circuit board material. Further, the substrate 102 may include a first surface (ex.—a top surface) 104 and a second surface (ex.—a bottom surface) 106 disposed generally opposite the first surface 104. Still further, a ground plane 108 may be connected to (ex.—may be configured on) the bottom surface 106 (as shown in FIG. 2A). In further embodiments of the present disclosure, the length of the antenna substrate 102 may be approximately one wavelength.

In further embodiments of the present disclosure, the parasitic antenna array 100 may further include a central element 110 connected to the substrate 102. For instance, the central element 110 may be a monopole element (ex.—a central monopole element) 110, or may be a monopole-type radiating element 110 (ex.—an ultra-wide band (UWB) monopole structure) that has the proper electrical properties to be suitable for parasitic array application. Further, the central element 110 may be connected to the substrate 102 and the ground plane 108 at a generally central location of the substrate 102 and the ground plane 108 (as shown in FIG. 1). Still further, the central element 110 may be an omni-directional element 110 configured for radiating electromagnetic energy in an omni-directional radiation pattern (ex.—in a monopole-like pattern). In further embodiments of the present disclosure, the central element 110 may be configured for being connected to a feed line (exs.—a Radio Frequency (RF) feed line, coaxial cable, printed circuit transmission line (such as microstrip, stripline, etc.) and/or the like) 112.

Figure 4:
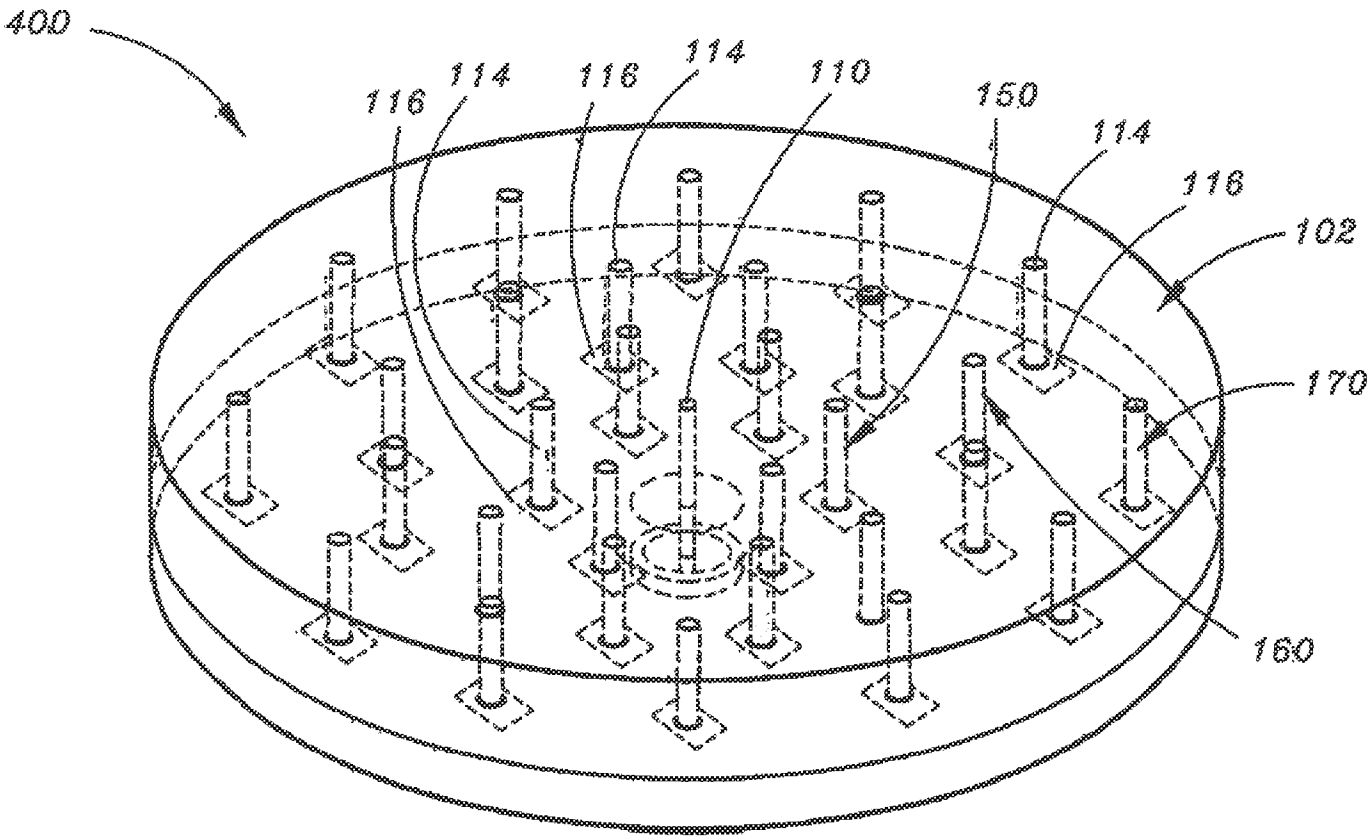
FIG. 4 is a view of a multi-ring switched parasitic antenna array in accordance with an exemplary embodiment of the present disclosure.

In exemplary embodiments of the present disclosure, the parasitic antenna array 100 may further include a plurality of parasitic elements (ex.—parasitic pins) 114. In the illustrated embodiment, the parasitic antenna array 100 includes six parasitic elements 114. However, varying numbers of parasitic elements 114 may be implemented in the parasitic antenna array 100 of the present disclosure. In further embodiments, the parasitic elements 114 may be connected to the substrate 102 and may be configured (exs.—oriented, arranged, located, established) in a generally circular arrangement so as to at least substantially surround (exs.—form a ring-like arrangement around, encircle) the central monopole element 110, wherein said central monopole element 110 may be generally centrally located within (ex.—may form the hub of) the ring created by the plurality of parasitic elements 114. In the illustrated embodiment of the present disclosure, one ring of parasitic elements 114 is established around the central monopole element 110. In alternative embodiments of the present disclosure, as shown in FIG. 4 and as discussed below, multiple (ex.—2 or more) rings of parasitic elements 114 may be configured around the central monopole element 110 for increasing gain of directional beams radiated by the parasitic antenna array 100. In an exemplary embodiment, the parasitic elements 114 may be thin wire (ex.—filamentary, narrow band) monopoles. In further embodiments, the parasitic elements 114 may be monopole-type radiating elements, such as ultra-wide band (UWB) monopole structures which have the proper electrical properties to be suitable for implementation for the concentric rings. In still further embodiments, the parasitic elements 114 included in a given ring of parasitic elements 114 may not all be the same type of radiating element. Further, in embodiments in which multiple rings of parasitic elements 114 are implemented, the parasitic elements 114 of a first ring may be different types of radiating elements than the parasitic elements 114 of a second ring.

In current exemplary embodiments of the present disclosure, each parasitic element 114 may be connected to a load (exs.—a load circuit, a variable impedance load) 116. For example, each parasitic element 114 may have a corresponding load circuit 116 connected (ex.—physically and electrically) to a base portion of said parasitic element 114 (as shown in FIG. 2A). In further embodiments, each load circuit 116 may be connected (ex.—physically and electrically) to the ground plane 108 configured on the bottom surface 106 of the substrate 102 (as shown in FIG. 2A). In still further embodiments of the present disclosure, each load circuit 116 may be an adjustable load circuit (ex.—an adjustable load) 116. Further, each load circuit 116 may be a parasitic load circuit (ex.—a parasitic load) 116.

Referring generally to FIG. 2A, a parasitic element 114 which is connected to its corresponding load circuit 116 is shown. In exemplary embodiments of the present disclosure, the load circuit 116 may include a plurality of diodes 118. For example, the load circuit 116 may include two diodes 118, such as two p-type, intrinsic, n-type (PIN) diodes 118. In further embodiments of the present disclosure, the load circuit 116 may further include one or more capacitors 120, the one or more capacitors 120 configured for being connected to at least one of the PIN diodes 118. In still further embodiments of the present disclosure, the load circuit 116 may further include a resistor 122, the resistor 122 configured for being connected to at least one of the one or more capacitors 120. In further embodiments of the present disclosure, the load circuit 116 may further include a Direct Current (DC) bias current source 124, the DC bias current source 124 configured for being connected to the resistor 122.

In current exemplary embodiments of the present disclosure, the two PIN diodes 118 of the load circuit 116 may be configured for being connected to each other. Further, the load circuit's corresponding parasitic element 114 may be configured for being connected between the two PIN diodes 118. Further, one of the two PIN diodes 118 may be configured for directly connecting the parasitic element 114 to the ground plane, while the other of the two PIN diodes 118 may be configured for connecting the parasitic element 114 to the ground plane 108 through one or more low impedance capacitors 120.

In exemplary embodiments of the present disclosure, the DC bias current source 124 may be configured for providing DC bias current to the resistor 122. The DC bias current may be transmitted through (ex.—may pass through) the resistor, thereby producing a voltage across the resistor 122. In further embodiments, the resistor 122 and capacitor(s) 120 may form a low pass filter for providing the DC bias current to the diodes 118. For example, in at least one embodiment, when electromagnetic energy is radiated by the monopole element 110, it may contact a parasitic element 114 and the electromagnetic energy (ex.—RF energy) may flow from the parasitic element 114 to a diode 118 of the load circuit 116 for that parasitic element and the RF energy may be shorted from the diode 118 directly to the ground plane 108 via the capacitor(s) 120. In still further embodiments, the resistor 122 may be small and/or may be sized to set a desired current level for a desired voltage.

Figure 3:
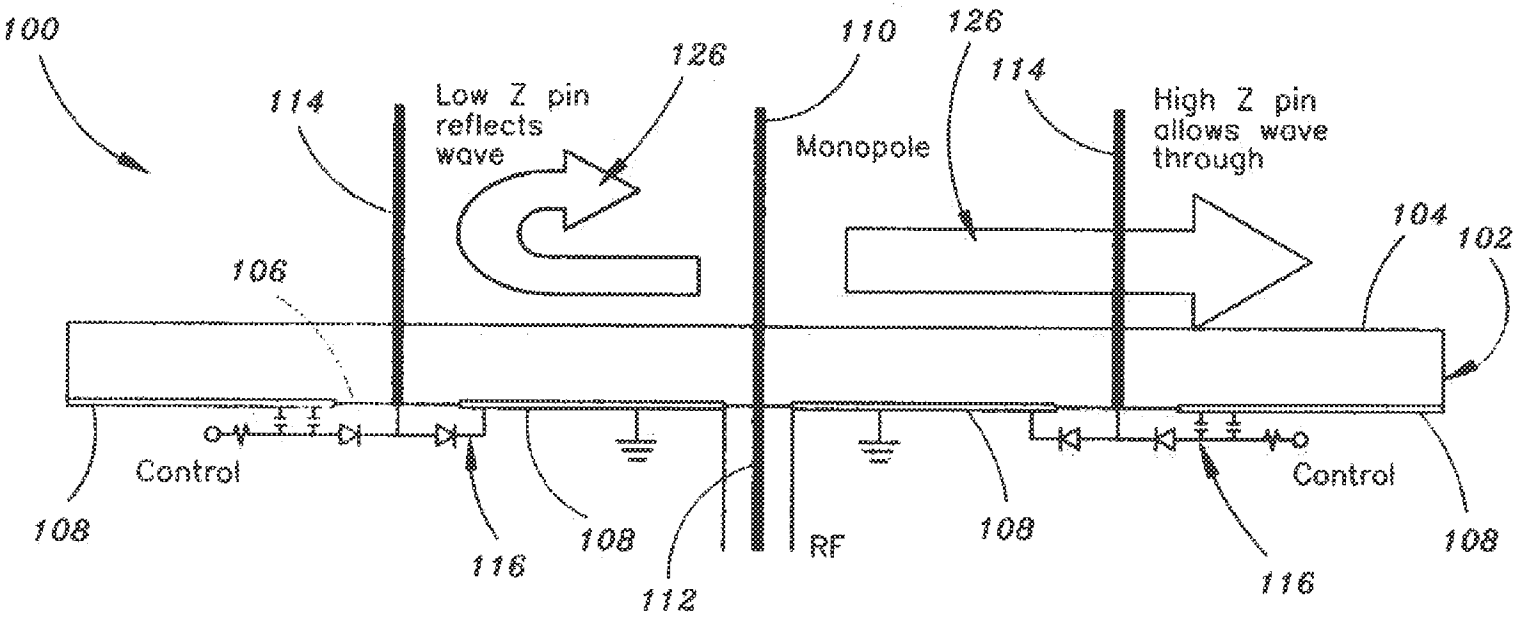
FIG. 3 is a block diagram schematic illustrating the operation of the parasitic antenna array shown in FIG. 1 in accordance with a further exemplary embodiment of the present disclosure.

In current exemplary embodiments of the present disclosure, the load circuit (ex.—variable impedance load) 116 may be configurable for allowing a variable (ex.—adjustable) impedance to be applied to the load circuit's corresponding parasitic element 114. As mentioned above, the monopole element 110 may be configured for receiving RF energy via the feed line 112 (as shown in FIG. 3). Further, based upon the received RF energy, the monopole element 110 may be configured for radiating electromagnetic energy (ex.—electromagnetic waves 126) in multiple directions (ex.—towards multiple parasitic elements 114 of the array 100). The electromagnetic waves 126 may excite a voltage (ex.—an applied voltage) on multiple parasitic elements 114. The relationship of the voltage and current present on a particular parasitic element 114 may be determined by the impedance (Z) applied to that parasitic element 114 via its load circuit 116 (ex.—a change in the voltage and current for the parasitic element 114 means that applied impedance provided via the load circuit 116 for that parasitic element 114 is changed also). For instance, when the applied impedance provided to a parasitic element 114 via its corresponding load circuit 116 is low (ex.—low Z), the current on that parasitic element 114 may be high (ex.—may be higher than the current present on the monopole element 110), which may cause the parasitic element 114 to reflect a wave radiated by the monopole 110 (as shown in FIG. 3). Further, when the applied impedance provided to a parasitic element via its corresponding load circuit 116 is high (ex. —high Z), the current on that parasitic element 114 may be low (ex.—may be lower than the current present on the monopole element 110), which may cause the parasitic element 114 to be transparent to a wave radiated by the monopole 110 (ex.—the parasitic element 114 may allow a wave radiated by the monopole 110 to pass through it). Thus, the applied impedance provided to each parasitic element 114 via its corresponding load circuit 116 may be selectively varied for causing the parasitic antenna array 100 to take (ex.—manipulate) the omni-directional monopole field radiated by the monopole element 110 and to radiate either multiple directional beams (ex.—azimuthal directional beams) or an omni-beam (ex.—a monopole-like radiation pattern). The parasitic antenna array 100 of the present disclosure is configured for applying the variable impedance to the parasitic elements 114 (via the variable impedance loads 116) for causing the antenna array 100 to produce a desired radiation pattern, and, unlike currently available parasitic antenna arrays, the parasitic antenna array 100 of the present disclosure is configured for doing this efficiently even at high (ex.—15 GHz) frequencies.

Figure 2B:
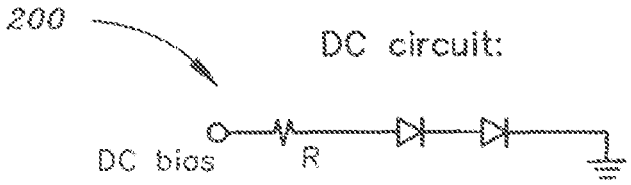
FIG. 2B is a block diagram schematic illustrating the operation of the load circuit shown in FIG. 2A when the parasitic antenna array is operating at low frequencies (ex.—3 GHz) in accordance with a further exemplary embodiment of the present disclosure.
Figure 2C:
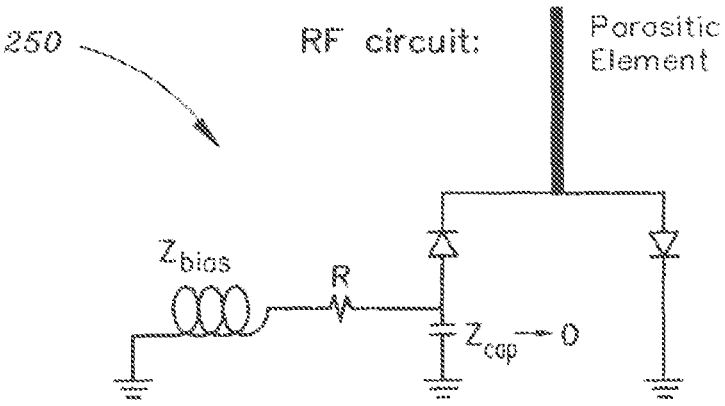
FIG. 2C is a block diagram schematic illustrating the operation of the load circuit shown in FIG. 2A when the parasitic antenna array is operating at high frequencies (ex.—15 GHz) in accordance with a still further exemplary embodiment of the present disclosure.

In exemplary embodiments of the present disclosure, it is the diodes 118 of each load circuit 116 which may control the RF load of each parasitic element, thereby affecting mutual coupling and reflectivity of the parasitic antenna array 100. In current exemplary embodiments of the present disclosure, depending upon the frequencies at which the parasitic antenna array 100 is operating at during a given time, the load circuit 116 may be configured for operating as a DC circuit or an RF circuit. For instance, when the parasitic antenna array 100 is operating at lower frequencies (ex.—3 GHz or below), each load circuit 116 may be configured for operating as a DC circuit 200 (as shown in FIG. 2B) in which the diodes 118 are placed in (ex.—connected in) series, thereby allowing the total DC current draw to be the same as a load circuit which implements only a single diode. As mentioned above, the parasitic antenna array 100 of the present disclosure is configured for applying the variable impedance to the parasitic elements 114 (via the variable impedance loads 116) for causing the antenna array 100 to produce a desired radiation pattern, and is configured for doing this efficiently even at high (ex.—15 GHz) frequencies. For instance, when the parasitic antenna array 100 is operating at higher frequencies (ex.—15 GHz), each load circuit 116 may be configured for operating as an RF circuit 250 (as shown in FIG. 2C) in which the diodes 118 are in parallel and any undesired impedance from the DC bias current source (ex.—DC bias circuit) 124 is shorted out by the parallel diode 118 tied directly to ground 108, thereby allowing the parasitic antenna array 100 of the present disclosure to provide dramatically improved performance and efficiency at higher frequencies relative to currently available parasitic antenna arrays 100.

The parasitic antenna array 100 of the present disclosure may provide improved RF and DC performance over currently available parasitic antenna arrays because the parasitic antenna array 100 of the present disclosure does not implement a biasing scheme which depends upon inductors (inductors may often be impractical and lossy at high frequencies), nor does the parasitic antenna array 100 of the present disclosure implement a biasing scheme which depends upon quarter wave matching sections (quarter wave matching sections may often be lossy and band limiting), nor does the parasitic antenna array 100 of the present disclosure implement a biasing scheme which depends upon large blocking resistors (large blocking resistors may be impractical for current-controlled devices).

Further, the parasitic antenna array 100 of the exemplary embodiments of the present disclosure may be configured for usage (ex.—practical usage) at higher microwave frequencies, such as up to Ku band (ex.—15 Gigahertz (GHz)). For example, the parasitic antenna array 100 of the present disclosure may exhibit a directional gain which is greater than 5 dBi (decibels (isotropic)) at 15 GHz. Further, the parasitic antenna array 100 of the exemplary embodiments of the present disclosure may be configured for being omni-directional, may be suitable for mobile microwave Intelligence Surveillance Reconnaissance (ISR) data links (ex.—ISR applications), and/or may be suitable for Unmanned Aerial Vehicles (UAV) applications, hand-held applications, soldier platforms, Miniature Common Data Link (MiniCDL) applications, and/or Quint Networking Technology (QNT) applications. Still further, the parasitic antenna array 100 of the present disclosure may represent a significant size, weight, power and cost (SWAP-C) improvement (exs.—smaller SWAP-C, greater than 50 times size, weight and cost reduction) compared to currently available Ku band antennas (ex.—Intelligence Surveillance and Reconnaissance (ISR) Ku band antennas).

Because the parasitic antenna array 100 of the present disclosure distributes thermal load across two devices (ex.—across two PIN diodes 118), the parasitic antenna array 100 of the present disclosure may provide improved power handling over currently available parasitic antenna arrays. Further, because the parasitic antenna array 100 of the exemplary embodiments of the present disclosure may dissipate power across multiple diodes 118, the parasitic antenna array of the present disclosure may be configured for achieving higher power operation (ex.—greater than 20 Watts (>20 W)) than currently available parasitic antenna arrays.

In further embodiments of the present disclosure, all interconnects for the parasitic antenna array 100 may be configured for being as short as possible, so as to remove any undesired impedances (ex.—undesired stray impedances). Further, because the ground plane 108 of the parasitic antenna array 100 of the present disclosure is configured on the same side (ex.—the bottom 106) of the substrate 102 as the load circuit 116, this eliminates the need for the parasitic antenna array 100 of the present disclosure to have inductive vias. This is advantageous as inductive vias often add significant impedance at high frequencies.

In exemplary embodiments of the present disclosure, large resistances may be placed in parallel with each diode 118 to balance reverse bias voltage across the diodes 118, such as when said diodes 118 are not well-matched. Said balancing of reverse bias voltage across the diodes 118 may be performed without significantly impacting RF performance.

In further alternative embodiments of the present disclosure, other two-terminal variable impedance devices may be implemented, such as varactor diodes and/or variable capacitors. Further, in some applications, FET switching transistors or any other transistor switch technologies may be substituted for PIN diode switches.

As mentioned above, in alternative embodiments of the present disclosure, multiple rings of parasitic elements 114 may be configured around the central monopole element 110 for increasing gain of directional beams radiated by the parasitic antenna array. FIG. 4 depicts a parasitic antenna array (exs.—a multi-ring parasitic antenna array 400, a multi-ring parasitic antenna 400) having multiple rings of parasitic elements 114 configured around the central monopole element 110. The multi-ring parasitic antenna array 400 (shown in FIG. 4) may be constructed in a same or similar manner as the parasitic antenna array 100 (shown in FIG. 1) discussed above, except that the multi-ring parasitic antenna array 400 may be configured with a larger number of parasitic elements 114, with said additional parasitic elements being configured around the first ring of parasitic elements 114 as part of additional rings of parasitic elements 114 formed around the central monopole element 110. For example, as shown in FIG. 4, the multi-ring parasitic array 400 may include a first ring 150 of parasitic elements 114 configured around the central monopole element 110, a second ring 160 of parasitic elements 114 configured around the central monopole element 110 (said second ring 160 also being configured around the first ring 150), and a third ring 170 of parasitic elements 114 configured around the central monopole element 110 (said third ring 170 also being configured around the second ring 160). Further, the multi-ring parasitic antenna array 400 may include additional corresponding load circuits 116 for each of the additional parasitic elements 114, said additional load circuits 116 being constructed in a same or similar manner as the load circuits 116 described above. By implementing the additional rings of parasitic elements 114, the multi-ring parasitic array 400 may radiate directional beams having increased gain over directional beams radiated by the parasitic antenna array 100 shown in FIG. 1. Thus, gain of the array 400 may increase with the number of rings of parasitic elements 114 being implemented. Further, the gain of the array 400 (ex.—antenna 400) may increase linearly with the diameter of the substrate 102 of the array 400. For example, doubling the diameter of the substrate 102 may cause a corresponding 3 decibel (dB) increase in the gain of the array 400. In further embodiments, the multi-ring parasitic array 400 may implement and/or may be a Circular Switched Parasitic Array (CSPA) with switched loads or an Electronically Steerable Parasitic Array Radiator (ESPAR) with analog tunable loads.

In further embodiments of the present disclosure, the applied impedances provided to the parasitic elements 114 of the multi-ring parasitic array 400 via their corresponding load circuits 116 may be selectively established, varied and/or re-established for causing the parasitic antenna array 400 to manipulate the omni-directional monopole field radiated by the monopole element 110 and to radiate either multiple directional beams (ex.—azimuthal directional beams) or an omni-beam (ex.—a monopole-like radiation pattern). The parasitic antenna array 400 of the present disclosure is configured for allowing variable impedances to be applied to the parasitic elements 114 (via the variable impedance loads 116) for causing the antenna array 400 to produce a desired radiation pattern. For example, in a first scenario, when an impedance applied to a parasitic element 114 is a first impedance value (ex.—a low impedance value), the resulting current on that parasitic element 114 may be high (ex.—may be a current value which is high, may be a current value which is higher than a current value present on the monopole element), thereby causing that parasitic element to reflect electromagnetic energy radiated by the central monopole 110 of the antenna array 400 (ex.—thereby causing said parasitic element to be an "on" element). Alternatively, in a second scenario, when an impedance applied to the parasitic element 114 is a second impedance value (ex.—a high impedance value, a higher impedance value than the first impedance value), the resulting current on the parasitic element 114 may be low (ex.—may be a low current value, may be a lower current value than the current value in the first scenario, may be a lower current value than a current value present on the monopole element), thereby causing the parasitic element 114 to be transparent to a wave radiated by the monopole 110 (ex.—thereby causing said parasitic element to be an "off" element).

Figure 5A:
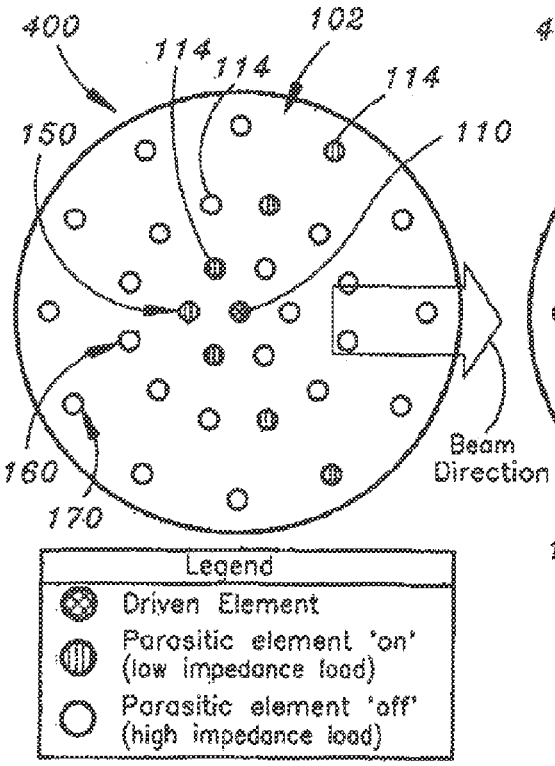
FIG. 5A is a top plan view of the multi-ring switched parasitic antenna array of FIG. 4, shown as having a first excitation pattern in accordance with an exemplary embodiment of the present disclosure, said FIG. 5A also showing a legend applicable to FIGS. 5A-5D.
Figure 5B:
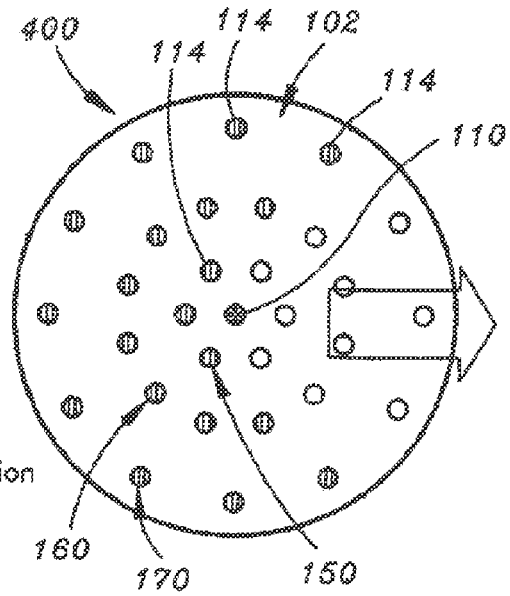
FIG. 5B is a top plan view of the multi-ring switched parasitic antenna array of FIG. 4, shown as having a second excitation pattern in accordance with a further exemplary embodiment of the present disclosure.
Figure 5C:
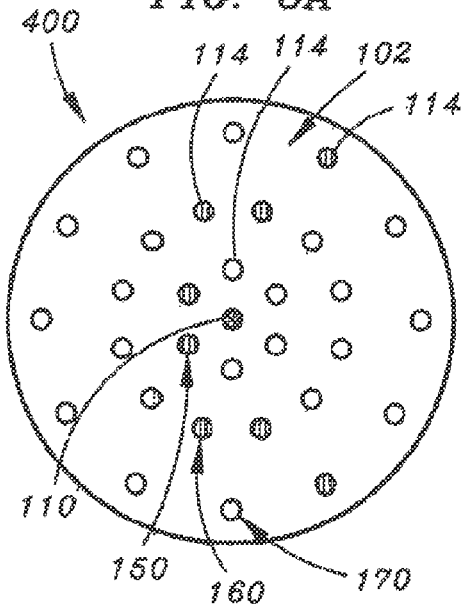
FIG. 5C is a top plan view of the multi-ring switched parasitic antenna array of FIG. 4, shown as having a third excitation pattern in accordance with a further exemplary embodiment of the present disclosure.
Figure 5D:
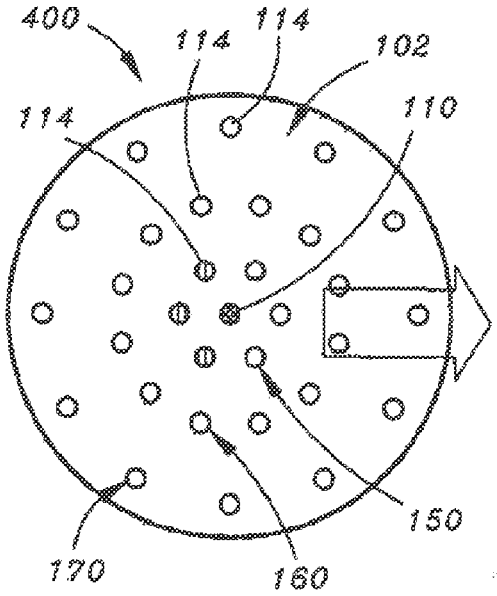
FIG. 5D is a top plan view of the multi-ring switched parasitic antenna array of FIG. 4, shown as having a fourth excitation pattern in accordance with a further exemplary embodiment of the present disclosure.

As mentioned above, the applied impedances provided to the parasitic elements 114 of the multi-ring parasitic array 400 via their corresponding load circuits 116 may be selectively established, varied and/or re-established for causing the parasitic antenna array 400 to manipulate the omni-directional monopole field radiated by the monopole element 110 and to radiate either multiple directional beams (ex.—azimuthal directional beams) or an omni-beam (ex.—a monopole-like radiation pattern). Parasitic elements 114 may be selectively established as "on" or "off" elements as described above, based upon the applied impedances provided to them via their corresponding load circuits 116. In further embodiments, as shown in FIGS. 5A, 5B, 5C and 5D, the parasitic elements 114 may be selectively established as being "on" or "off", such that any one of a number of various subsets (ex.—patterns) of parasitic elements 114 included in the plurality of parasitic elements 114 may be established as "on" elements, said "on" elements functioning as a steerable reflector. In an exemplary embodiment, the subset (ex.—pattern) of "on" elements 114 may be strategically selected for promoting maximum DC power efficiency (FIG. 5A) and/or for promoting maximum RF gain (FIG. 5B). For instance, parasitic elements 114 of the second ring 160, which are positioned behind the "on" elements 114 of the first ring 150 may be selectively established to be "on" elements 114 for promoting maximum RF gain (as shown in FIG. 5B) or may be selectively established as being "off" elements 114 for promoting maximum DC power efficiency (ex.—low DC power draw) (as shown in FIG. 5A). Arrows shown in FIGS. 5A, 5B and 5D depict the direction of the beam(s) provided via the multi-ring switched parasitic antenna array 400 when said array 400 is established with the excitation patterns depicted in FIGS. 5A, 5B and 5D.

In further embodiments, as the number of rings increases, more beams may be required than a number of rotationally symmetric positions. Thus, alternate beamstates may be excited (ex.—alternate patterns parasitic elements 114 may be established as "on" elements) for steering a beam in a different direction and/or in a different plane of symmetry (as shown in FIG. 5C). In still further embodiments, alternate beamstates may be excited (ex.—alternate patterns parasitic elements 114 may be established as "on" elements) for adjusting beamwidth (FIG. 5D); steering simultaneous beams, steering simultaneous beams and nulls; and/or providing different beam types (ex.—omni-beam, multi-beam, nulling, beam broadening, etc.). In further embodiments, an array of LEDs in a same pattern as the parasitic elements (ex.—parasitic pins) 114 may be used for visualizing antenna excitation. For example, the LEDs may be integrated onto a same board as the pins 114 or onto a separate board from the pins 114, and may be used for troubleshooting, diagnostics, demonstration and/or integration.

Further, the parasitic antenna array 400 of the exemplary embodiments of the present disclosure may be configured for being omni-directional, may be suitable for mobile microwave Intelligence Surveillance Reconnaissance (ISR) data links (ex.—ISR applications), and/or may be suitable for Unmanned Aerial Vehicles (UAV) applications, hand-held applications, soldier platforms, Miniature Common Data Link (MiniCDL) applications, Air-to-Ground (ATG) 4G cellular and/or Quint Networking Technology (QNT) applications. Still further, the parasitic antenna array 400 of the present disclosure may represent a significant size, weight, power and cost (SWAP-C) improvement (exs.—smaller SWAP-C, greater than 50 times size, weight and cost reduction) compared to currently available Ku band antennas (ex.—Intelligence Surveillance and Reconnaissance (ISR) Ku band antennas).

Figure 6A:
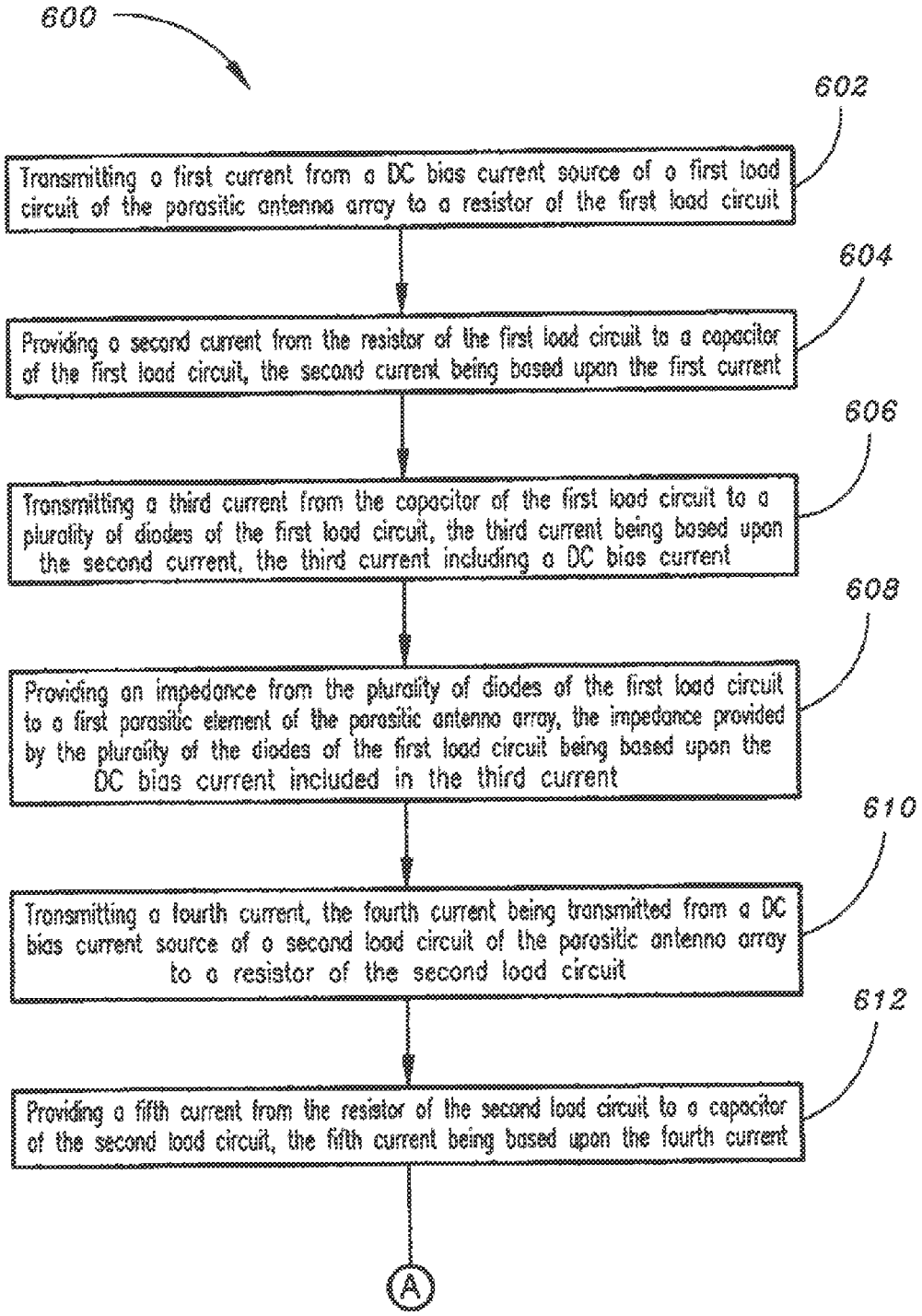
FIGS. 6A and 6B depict a flowchart illustrating a method of operation of the multi-ring parasitic antenna array of FIG. 4, in accordance with a further exemplary embodiment of the present disclosure.
Figure 6B:
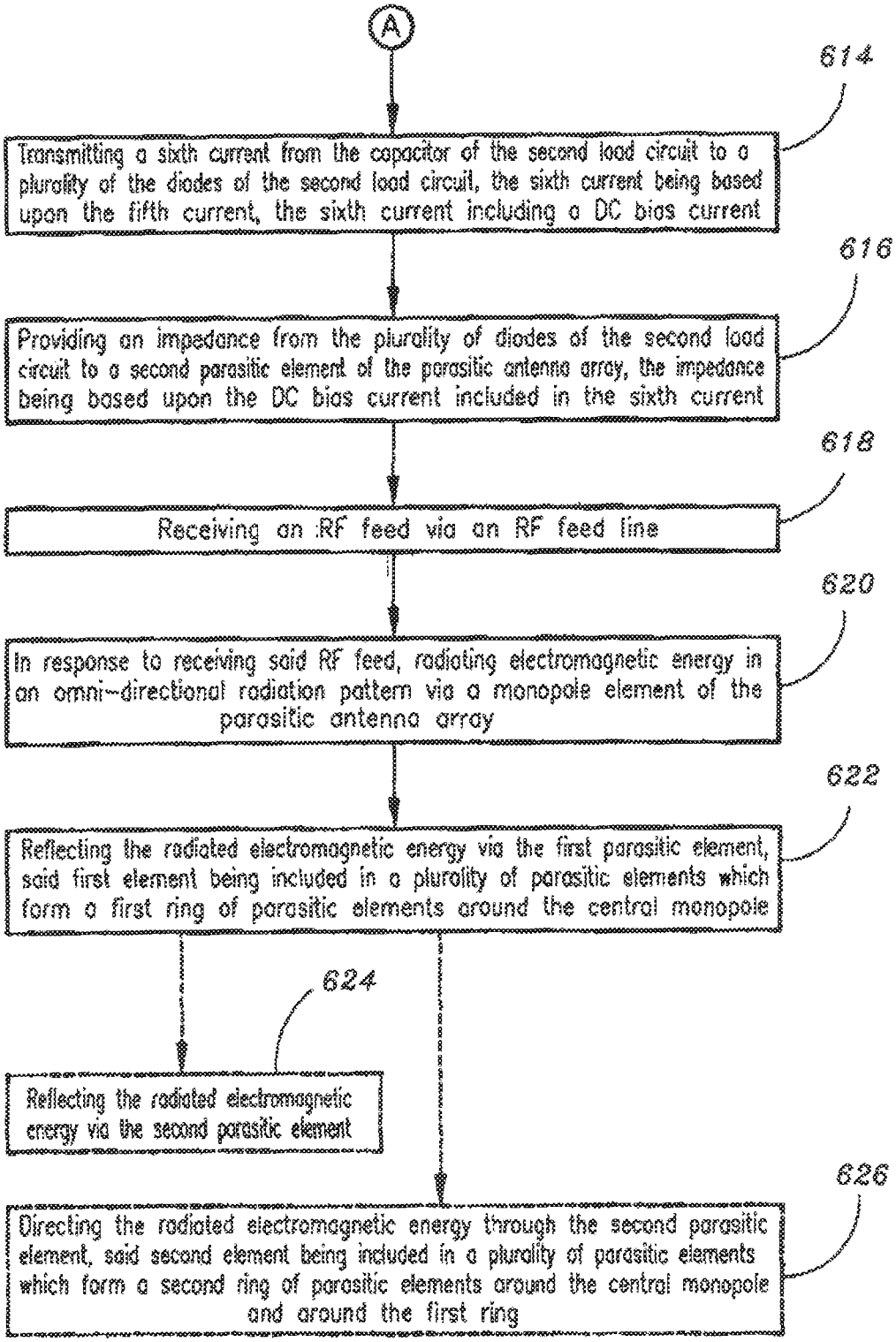

Referring generally to FIGS. 6A and 6B, a flowchart illustrating a method of operation of a parasitic antenna array of the present disclosure in accordance with an exemplary embodiment of the present disclosure is shown. The method 600 may include the step of transmitting a first current from a DC bias current source of a first load circuit of the parasitic antenna array to a resistor of the first load circuit 602. The method 600 may further include the step of providing a second current from the resistor of the first load circuit to a capacitor of the first load circuit, the second current being based upon the first current 604. The method 600 may further include the step of transmitting a third current from the capacitor of the first load circuit to a plurality of diodes of the first load circuit, the third current being based upon the second current, the third current including a DC bias current 606. The method 600 may further include the step of providing an impedance from the plurality of diodes of the first load circuit to a first parasitic element of the parasitic antenna array, the impedance provided by the plurality of diodes of the first load circuit being based upon the DC bias current included in the third current 608.

In exemplary embodiments of the present disclosure, the method 600 may further include the step of transmitting a fourth current, the fourth current being transmitted from a DC bias current source of a second load circuit of the parasitic antenna array to a resistor of the second load circuit 610. The method 600 may further include the step of providing a fifth current from the resistor of the second load circuit to a capacitor of the second load circuit, the fifth current being based upon the fourth current 612. The method 600 may further include the step of transmitting a sixth current from the capacitor of the second load circuit to a plurality of diodes of the second load circuit, the sixth current being based upon the fifth current, the sixth current including a DC bias current 614. The method 600 may further include the step of providing an impedance from the plurality of diodes of the second load circuit to a second parasitic element of the parasitic antenna array, the impedance being based upon the DC bias current included in the sixth current 616.

The method 600 may further include the step of receiving an RF feed via an RF feed line 618. The method 600 may further include the step of, in response to receiving said RF feed, radiating electromagnetic energy in an omni-directional radiation pattern via a monopole element of the parasitic antenna array 620. In further embodiments, the method 600 may further include the step of reflecting the radiated electromagnetic energy via the first parasitic element 622. In exemplary embodiments, the first parasitic element may be included in a plurality of parasitic elements which form a first ring 150 of parasitic elements 114 around the central monopole 110. The method 600 may further include the step of reflecting the radiated electromagnetic energy via the second parasitic element 624 or alternatively, the step of directing the radiated electromagnetic energy through the second parasitic element (ex.—the second parasitic element is transparent to the radiated electromagnetic energy) 626. In exemplary embodiments, the second parasitic element may be included in a plurality of parasitic elements which form a second ring 160 of parasitic elements 114 around the central monopole 110, said second ring 160 also being formed around the first ring 150. In further embodiments, the method 600 may include the step of shorting RF energy from a diode included in the plurality of diodes of the first load circuit directly to a ground plane of the parasitic antenna array via the capacitor of the first load circuit 628 (not shown). In still further embodiments, the method 600 may include the step of shorting RF energy from a diode included in the plurality of diodes of the second load circuit directly to the ground plane of the parasitic antenna array via the capacitor of the second load circuit 630 (not shown).

It is understood that the specific order or hierarchy of steps in the foregoing disclosed methods are examples of exemplary approaches. Based upon design preferences, it is understood that the specific order or hierarchy of steps in the method can be rearranged while remaining within the scope of the present disclosure. The accompanying method claims present elements of the various steps in a sample order, and are not meant to be limited to the specific order or hierarchy presented.

It is believed that the present disclosure and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely an explanatory embodiment thereof, it is the intention of the following claims to encompass and include such changes.

What is claimed is:

1. A parasitic antenna array, comprising:

a substrate;

a ground plane, the ground plane being directly connected to a bottom surface of the substrate;

a monopole element, the monopole element being connected to the substrate, the monopole element configured for radiating electromagnetic energy in an omnidirectional radiation pattern;

a first plurality of parasitic elements, the first plurality of parasitic elements being connected to the substrate, the first plurality of parasitic elements collectively forming a first ring, said first ring being formed around the monopole element;

a second plurality of parasitic elements, the second plurality of parasitic elements being connected to the substrate, the second plurality of parasitic elements collectively forming a second ring, said second ring being formed around the monopole element and being formed around the first ring; and a plurality of variable impedance load circuits, each of the plurality of variable impedance load circuits including a plurality of diodes, each of the plurality of variable impedance load circuits being connected to a particular parasitic element, the plurality of variable impedance load circuits further being directly connected to the ground plane.

2. A parasitic antenna array as claimed in claim 1, further comprising:

a feed line, the feed line being connected to the monopole element, the feed line configured for providing RF energy to the monopole element.

3. A parasitic antenna array as claimed in claim 1, wherein a first variable impedance load circuit included in the plurality of variable impedance load circuits is connected to a base of a first parasitic element included in the parasitic elements.

4. A parasitic antenna array as claimed in claim 3, wherein the first variable impedance load circuit is configured for providing an adjustable impedance to the first parasitic element.

5. A parasitic antenna array as claimed in claim 4, wherein the first parasitic element is selectively configurable, based upon the adjustable impedance provided to the first parasitic element by the first variable impedance load circuit, for: reflecting the electromagnetic energy radiated from the monopole element when a first impedance of the adjustable impedance is provided to the first parasitic element by the first variable impedance load circuit; and allowing transmission through the first parasitic element of the electromagnetic energy radiated from the monopole element when a second impedance of the adjustable impedance is provided to the first parasitic element by the first variable impedance load circuit.

6. A parasitic antenna array as claimed in claim 1, wherein each of the first plurality of parasitic elements comprises a different type of radiating element than the second plurality of parasitic elements.

7. A parasitic antenna array as claimed in claim 1, further comprising:

an array of light emitting diodes (LEDs) arranged in a same pattern as the first plurality of parasitic elements and the second plurality of parasitic elements, wherein the array of LEDs is configured for visualization of antenna excitation.

8. A parasitic antenna array as claimed in claim 1, wherein a subset of the first plurality of parasitic elements and a subset of the second plurality of parasitic elements are configured to form a steerable reflector.

9. A parasitic antenna array as claimed in claim 1, wherein two diodes of the plurality of diodes of each of the plurality of variable impedance load circuits are p-type, intrinsic, n-type (PIN) diodes.

10. A method of operation of a parasitic antenna array, the parasitic array including a substrate, a ground plane, a plurality of variable impedance load circuits, a monopole element, and a plurality of parasitic elements collectively forming two or more rings around the monopole element, the method comprising:

selectively establishing a subset of the plurality of parasitic elements as on elements to form a steerable reflector of the parasitic antenna array, wherein the ground plane of the parasitic antenna array is directly connected to a bottom surface of the substrate and the plurality of variable impedance load circuits of the parasitic antenna array are directly connected to the ground plane, wherein each of the plurality of variable impedance load circuits includes at least two diodes, a capacitor connected to a first diode of the at least two diodes, and a resistor connected to a second diode of the at least two diodes, wherein selectively establishing the subset of the plurality of parasitic elements as the on elements to form the steerable reflector at least includes:

transmitting a first current from a DC bias current source of a first variable impedance load circuit of the parasitic antenna array to a resistor of the first variable impedance load circuit;

providing a second current from the resistor of the first variable impedance load circuit to a capacitor of the first load circuit, the second current being based upon the first current;

transmitting a third current from the capacitor of the first variable impedance load circuit to a plurality of diodes of the first variable impedance load circuit, the third current being based upon the second current, the third current including a DC bias current;

providing an impedance from the plurality of diodes of the first variable impedance load circuit to a first parasitic element of the parasitic antenna array, the impedance being based upon the DC bias current included in the third current;

transmitting a fourth current, the fourth current being transmitted from a DC bias current source of a second variable impedance load circuit of the parasitic antenna array to a resistor of the second variable impedance load circuit;

providing a fifth current from the resistor of the second variable impedance load circuit to a capacitor of the second variable impedance load circuit, the fifth current being based upon the fourth current;

transmitting a sixth current from the capacitor of the second variable impedance load circuit to a plurality of diodes of the second variable impedance load circuit, the sixth current being based upon the fifth current, the sixth current including a DC bias current; and providing an impedance from the plurality of diodes of the second variable impedance load circuit to a second parasitic element of the parasitic antenna array, the impedance being based upon the DC bias current included in the sixth current.

11. A method as claimed in claim 10, further comprising: receiving an RF feed via an RF feed line.

12. A method as claimed in claim 11, further comprising: in response to receiving said RF feed, radiating electromagnetic energy in an omni-directional radiation pattern via the monopole element of the parasitic antenna array.

13. A method as claimed in claim 12, further comprising: reflecting the radiated electromagnetic energy via the first parasitic element, the first parasitic element being one of a first plurality of parasitic elements, said first plurality of parasitic elements forming a first ring, said first ring being formed around the monopole element.

14. A method as claimed in claim 13, further comprising: reflecting the radiated electromagnetic energy via the second parasitic element, the second parasitic element being one of a second plurality of parasitic elements, said second plurality of parasitic elements forming a second ring, said second ring being formed around the monopole element and also being formed around the first ring.

15. A method as claimed in claim 13, further comprising: directing the radiated electromagnetic energy through the second parasitic element, the second parasitic element being one of a second plurality of parasitic elements, said second plurality of parasitic elements forming a second ring, said second ring being formed around the monopole element and also being formed around the first ring.

16. A method as claimed in claim 13, further comprising: shorting RF energy from a diode included in the plurality of diodes of the first variable impedance load circuit directly to the ground plane of the parasitic antenna array via the capacitor of the first variable impedance load circuit.

17. A method as claimed in claim 13, further comprising: shorting RF energy from a diode included in the plurality of diodes of the second variable impedance load circuit directly to the ground plane of the parasitic antenna array via the capacitor of the second variable impedance load circuit.

18. A method of operation of a parasitic antenna array as claimed in claim 10, wherein the subset of the plurality of parasitic elements being the on elements includes all of the parasitic elements behind a leading edge of the steerable reflector.

19. A parasitic antenna array, comprising:

a substrate;

a ground plane, the ground plane being directly connected to a bottom surface of the substrate;

a monopole element, the monopole element being connected to the substrate, the monopole element configured for radiating electromagnetic energy in an omni-directional radiation pattern;

a first plurality of parasitic elements, the first plurality of parasitic elements being connected to the substrate, the first plurality of parasitic elements collectively forming a first ring, said first ring being formed around the monopole element;

a second plurality of parasitic elements, the second plurality of parasitic elements being connected to the substrate, the second plurality of parasitic elements collectively forming a second ring, said second ring being formed around the monopole element and being formed around the first ring; and a plurality of variable impedance load circuits, each of the plurality of variable impedance load circuits including a plurality of diodes, the plurality of variable impedance load circuits being connected to the parasitic elements and the ground plane, wherein a first variable impedance load circuit included in the plurality of load circuits is connected to a base of a first parasitic element included in the parasitic elements, said variable impedance load circuit being configured for providing an adjustable impedance to the first parasitic element, wherein the first parasitic element is selectively configurable, based upon the adjustable impedance provided to the first parasitic element by the first variable impedance load circuit, for: reflecting the electromagnetic energy radiated from the monopole element when a first impedance of the adjustable impedance is provided to the first parasitic element by the first variable impedance load circuit; and allowing transmission through the first parasitic element of the electromagnetic energy radiated from the monopole element when a second impedance of the adjustable impedance is provided to the first parasitic element by the first variable impedance load circuit.

* * * * *